US007086933B2

(12) United States Patent
Vereen et al.

(10) Patent No.: US 7,086,933 B2
(45) Date of Patent: Aug. 8, 2006

(54) FLEXIBLE POLISHING FLUID DELIVERY SYSTEM

(75) Inventors: Lidia Vereen, Pleasanton, CA (US); Peter N. Skarpelos, Berkeley, CA (US); Brian J. Downum, Vancouver, WA (US); Patrick Williams, Tracy, CA (US); Terry Kin-Ting Ko, South San Francisco, CA (US); Christopher Heung-Gyun Lee, Alameda, CA (US); Kenneth Reese Reynolds, Los Gatos, CA (US); John Hearne, Los Altos, CA (US); Daniel Hachnochi, Palo Alto, CA (US)

(73) Assignee: Applied Materials, Inc., Santa Clara, CA (US)

( * ) Notice: Subject to any disclaimer, the term of this patent is extended or adjusted under 35 U.S.C. 154(b) by 61 days.

(21) Appl. No.: 10/131,638

(22) Filed: Apr. 22, 2002

(65) Prior Publication Data

US 2003/0199229 A1 Oct. 23, 2003

(51) Int. Cl.
*B24B 1/00* (2006.01)

(52) U.S. Cl. ..... 451/36; 451/36; 451/41

(58) Field of Classification Search ..... 451/36, 451/41, 60, 446

See application file for complete search history.

(56) References Cited

U.S. PATENT DOCUMENTS 4,471,579 A * 9/1984 Bovensiepen ..... 451/7
5,407,526 A 4/1995 Danielson et al.
5,433,650 A * 7/1995 Winebarger ..... 451/6
5,527,161 A 6/1996 Bailey et al.
5,578,529 A * 11/1996 Mullins ..... 438/692
5,584,749 A * 12/1996 Mitsuhashi et al. ..... 451/285
5,605,488 A 2/1997 Ohashi et al. ..... 451/7
5,630,527 A 5/1997 Beebe et al.
5,651,725 A 7/1997 Kikuta et al. ..... 451/41
5,679,063 A * 10/1997 Kimura et al. ..... 451/287
5,702,563 A 12/1997 Salugsugan et al. ..... 156/636.1
5,709,593 A 1/1998 Guthrie et al. ..... 451/287
5,716,264 A 2/1998 Kimura et al. ..... 451/443
5,738,574 A 4/1998 Tolles et al.
5,750,440 A 5/1998 Vanell et al.
5,762,537 A 6/1998 Sandhu et al.
5,791,970 A 8/1998 Yueh
5,816,900 A 10/1998 Nagahara et al. ..... 451/285
5,882,243 A 3/1999 Das et al. ..... 451/5
5,887,974 A 3/1999 Pozniak et al.
5,888,121 A 3/1999 Kirchner et al. ..... 451/41
5,893,753 A * 4/1999 Hempel, Jr. ..... 438/691
5,899,800 A 5/1999 Shendon
5,945,346 A 8/1999 Vanell et al.
6,012,967 A 1/2000 Satake et al. ..... 451/36
6,053,801 A * 4/2000 Pinson et al. ..... 451/56
6,056,631 A 5/2000 Brown et al. ..... 451/288

(Continued)

*Primary Examiner*—Lee D. Wilson
*Assistant Examiner*—Alvin J. Grant
(74) *Attorney, Agent, or Firm*—Patterson and Sheridan

(57) ABSTRACT

A method and apparatus for delivering a polishing fluid to a chemical mechanical polishing surface is provided. In one embodiment, an apparatus for delivering a polishing fluid to a chemical mechanical polishing surface includes an arm having a plurality of holes formed in the arm for retaining a plurality of polishing fluid delivery tubes. Each of the tubes are disposed through one of the holes and coupled to the arm. The number of holes exceeds the number of tubes, thereby allowing the distribution of polishing fluid to a polishing surface and correspondingly the local polishing rates across a diameter of a substrate being polished to be controlled.

27 Claims, 5 Drawing Sheets

U.S. PATENT DOCUMENTS 6,059,920 A 5/2000 Nojo et al.
6,116,988 A 9/2000 Ball ..... 451/41
6,139,406 A * 10/2000 Kennedy et al. ..... 451/67
6,183,341 B1 2/2001 Melcer
6,261,162 B1 7/2001 Hirokawa et al.
6,280,299 B1 * 8/2001 Kennedy et al. ..... 451/67
6,315,635 B1 11/2001 Lin ..... 451/7
6,336,850 B1 1/2002 Wada et al.
6,338,669 B1 * 1/2002 Togawa et al. ..... 451/36
6,348,124 B1 2/2002 Garbett et al. ..... 156/345
6,398,627 B1 * 6/2002 Chiou et al. ..... 451/72
6,544,109 B1 * 4/2003 Moore ..... 451/60

* cited by examiner

FLEXIBLE POLISHING FLUID DELIVERY SYSTEM

CROSS-REFERENCE TO RELATED APPLICATIONS

This application is related to U.S. patent application Ser. No. 09/921,588, filed Aug. 2, 2001, which is hereby incorporated by reference in its entirety.

BACKGROUND OF THE INVENTION

1. Field of the Invention

Embodiments of the invention generally relate to a method and apparatus for distributing fluid in a chemical mechanical polishing system.

2. Description of the Related Art

In semiconductor wafer processing, the use of chemical mechanical planarization, or CMP, has gained favor due to the enhanced ability to increase device density on a semiconductor workpiece, or substrate, such as a wafer. Chemical mechanical planarization systems generally utilize a polishing head to retain and press a substrate against a polishing surface of a polishing material while providing motion therebetween. Some planarization systems utilize a polishing head that is moveable over a stationary platen that supports the polishing material. Other systems utilize different configurations to provide relative motion between the polishing material and the substrate, for example, providing a rotating platen. A polishing fluid is typically disposed between the substrate and the polishing material during polishing to provide chemical activity that assists in the removal of material from the substrate. Some polishing fluids may also contain abrasives.

One of the challenges in developing robust polishing systems and processes is controlling the uniformity of material removed across the polished surface of the substrate. For example, as the substrate travels across the polishing surface, the edge of the substrate is often polished at a higher rate. This is due in part to the tendency of the substrate to "nose drive" due to frictional forces as the substrate moves across the polishing surface.

Another problem affecting polishing uniformity across the substrate's surface is the tendency of some materials to be removed faster than the surrounding materials. For example, copper is generally removed more rapidly than the material surrounding the copper material (typically an oxide) during polishing. The faster removal of copper, often referred to a dishing, is particularly evident when the width of the copper surface exceeds five microns.

Although many solutions have been utilized in order to mitigate the non-uniformity of the substrate as a result of polishing, none have proved to be completely satisfactory. Thus, the demand for uniform, highly planarized surfaces is still a paramount concern due to the trend toward smaller decreased line sizes and increased device density.

Therefore, there is a need for improved polishing uniformity in chemical mechanical planarization systems.

SUMMARY OF THE INVENTION

In one aspect of the invention, an apparatus for delivering a polishing fluid to a chemical mechanical polishing surface includes an arm having a plurality of holes formed in the arm for retaining a plurality of polishing fluid delivery tubes. Each of the tubes are disposed through one of the holes and coupled to the arm. The number of holes exceeds the number of tubes, thereby allowing the distribution of polishing fluid to a polishing surface and correspondingly the local polishing rates across a diameter of a substrate being polished to be controlled.

In another aspect of the invention, a method for delivering a polishing fluid to a chemical mechanical polishing surface is provided. In one embodiment, a method for delivering a polishing fluid to a chemical mechanical polishing surface includes the steps of flowing polishing fluid to a first portion of the polishing surface through a first polishing fluid delivery tube while a second portion of the polishing surface receives no flow, and flowing polishing fluid through a second polishing fluid delivery tube to the second portion of the polishing surface.

In another embodiment, a method for delivering a polishing fluid to a chemical mechanical polishing surface includes the steps of providing a polishing fluid delivery arm having a plurality of tube retaining positions exceeding the number of polishing fluid delivery tubes coupled to the arm, and selecting a relative spacing between at least a first and a second polishing fluid delivery tube along the arm from the plurality of tube retaining positions to produce a desired polishing result.

DESCRIPTION OF THE DRAWINGS

So that the manner in which the above recited features of the present invention are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, wherever possible, to designate identical elements that are common to the figures.

DETAILED DESCRIPTION OF THE PREFERRED EMBODIMENT

Figure 1:
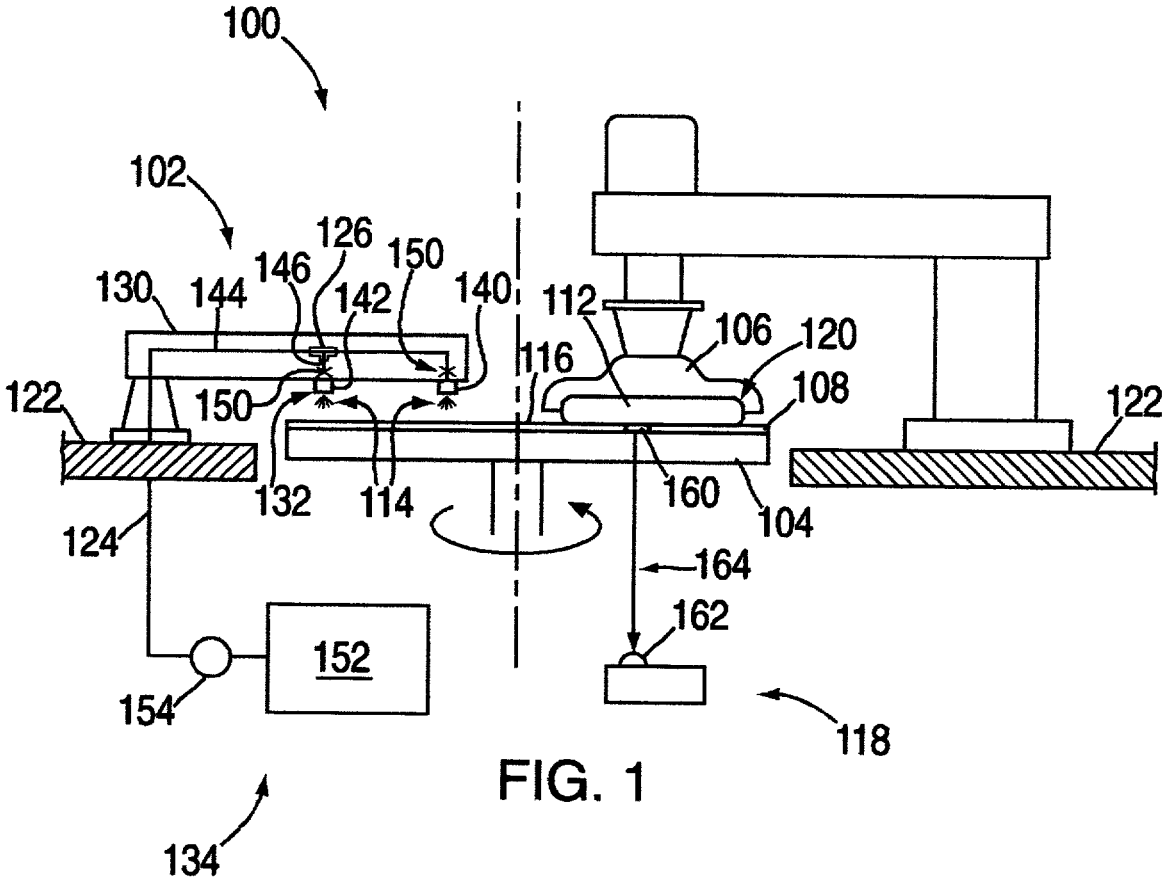
FIG. 1 is a simplified schematic of a polishing system having one embodiment of a polishing fluid delivery apparatus.

FIG. 1 depicts one embodiment of a polishing system 100 for polishing a substrate 112 having a polishing fluid delivery system 102 that controls the distribution of polishing fluid 114 across a polishing material 108. Examples of polishing systems which may be adapted to benefit from aspects of the invention are disclosed in U.S. Pat. No. 6,244,935, issued Jun. 12, 2001 to Birang, et al. and U.S. Pat. No. 5,738,574, issued Apr. 14, 1998 to Tolles, et al., both of which are hereby incorporated by reference in their entirety. Although the polishing fluid delivery system 102 is described in reference to the illustrative polishing system 100, the invention has utility in other polishing systems that process substrates in the presence of a polishing fluid.

Generally, the exemplary polishing system 100 includes a platen 104 and a polishing head 106. The platen 104 is generally positioned below the polishing head 106 that holds the substrate 112 during polishing. The platen 104 is generally disposed on a base 122 of the system 100 and coupled to a motor (not shown). The motor rotates the platen 104 to provide at least a portion of a relative polishing motion between the polishing material 108 disposed on the platen 104 and the substrate 112. It is understood that relative motion between the substrate 112 and the polishing material 108 may be provided in other manners. For example, at least a portion of the relative motion between the substrate 112 and polishing material 108 may be provided by moving the polishing head 106 over a stationary platen 104, moving the polishing material linearly under the substrate 112, moving both the polishing material 108 and the polishing head 106 and the like.

The polishing material 108 is generally supported by the platen 104 so that a polishing surface 116 faces upward towards the polishing head 106. Typically, the polishing material 108 is fixed to the platen 104 by adhesives, vacuums, mechanical clamping or the like during processing. Optionally, and particularly in applications where the polishing material 108 is configured as a web, the polishing material 108 is releasably fixed to the platen 104, typically by use of a vacuum disposed between the polishing material 108 and platen 104 as described in the previously incorporated U.S. patent application No. 6,244,935.

The polishing material 108 may be a conventional or a fixed abrasive material. Conventional polishing material 108 is generally comprised of a foamed polymer and disposed on the platen 104 as a pad. Conventional material 108 includes those made from polyurethane and/or polyurethane mixed with fillers, which are commercially available from a number of commercial sources.

Fixed abrasive polishing material 108 is generally comprised of a plurality of abrasive particles suspended in a resin binder that is disposed in discrete elements on a backing sheet. Fixed abrasive polishing material 108 may be utilized in either pad or web form. As the abrasive particles are contained in the polishing material itself, systems utilizing fixed abrasive polishing materials generally utilize polishing fluids that do not contain abrasives. Examples of fix abrasive polishing material are disclosed in U.S. Pat. No. 5,692,950, issued Dec. 2, 1997 to Rutherford et al., and U.S. Pat. No. 5,453,312, issued Sep. 26, 1995 to Haas et al, both of which are hereby incorporated by reference in their entireties.

The polishing head 106 generally is supported above the platen 104. The polishing head 106 retains the substrate 112 in a recess 120 that faces the polishing surface 116. The polishing head 106 typically moves toward the platen 104 and presses the substrate 112 against the polishing material 108 during processing. The polishing head 106 may be stationary or rotate, isolate, move orbitally, linearly or a combination of motions while pressing the substrate 112 against the polishing material 108. One example of a polishing head 106 that may be adapted to benefit from the invention is described in U.S. Pat. No. 6,183,354 B1, issued Feb. 6, 2001 to Zuniga et al., and is hereby incorporated by reference in its entirety. Another example of a polishing head 106 that may be adapted to benefit from the invention is a TITAN HEAD™ wafer carrier, available from Applied Materials, Inc., of Santa Clara, Calif.

The polishing fluid delivery system 102 generally comprises a delivery arm 130, a plurality of nozzles 132 disposed on the arm 130 and at least one polishing fluid source 134. The delivery arm 130 is configured to dispense polishing fluid 114 at different locations along the arm 130 to control the distribution of polishing fluid 114 on the polishing surface 116 of the polishing material 108. As the polishing fluid 114 is generally supplied from a single source, the polishing fluid 114 is disposed on the polishing material 108 in a uniform concentration but in different locations along the width (or diameter) of the polishing material 108.

The delivery arm 130 is generally coupled to the base 122 proximate the platen 104. The delivery arm 130 generally has at least a portion 136 that is suspended over the polishing material 108. The delivery arm 130 may be coupled to other portions of the system 100 as long as the portion 136 is positionable to deliver polishing fluid 114 to the polishing surface 116.

The plurality of nozzles 132 are disposed along the portion 136 of the delivery arm 130 which is disposed above the platen 104. In one embodiment, the nozzles 132 comprise at least a first nozzle 140 and a second nozzle 142. Typically, the first nozzle 140 is positioned on the arm 130 radially inward of the second nozzle 142 relative to the center of rotation of the polishing material 108. The distribution of polishing fluid 114 across the polishing material 108 is controlled by selectively flowing polishing fluid 114 from either the first nozzle 140 or from the second nozzle 142.

Figure 2:
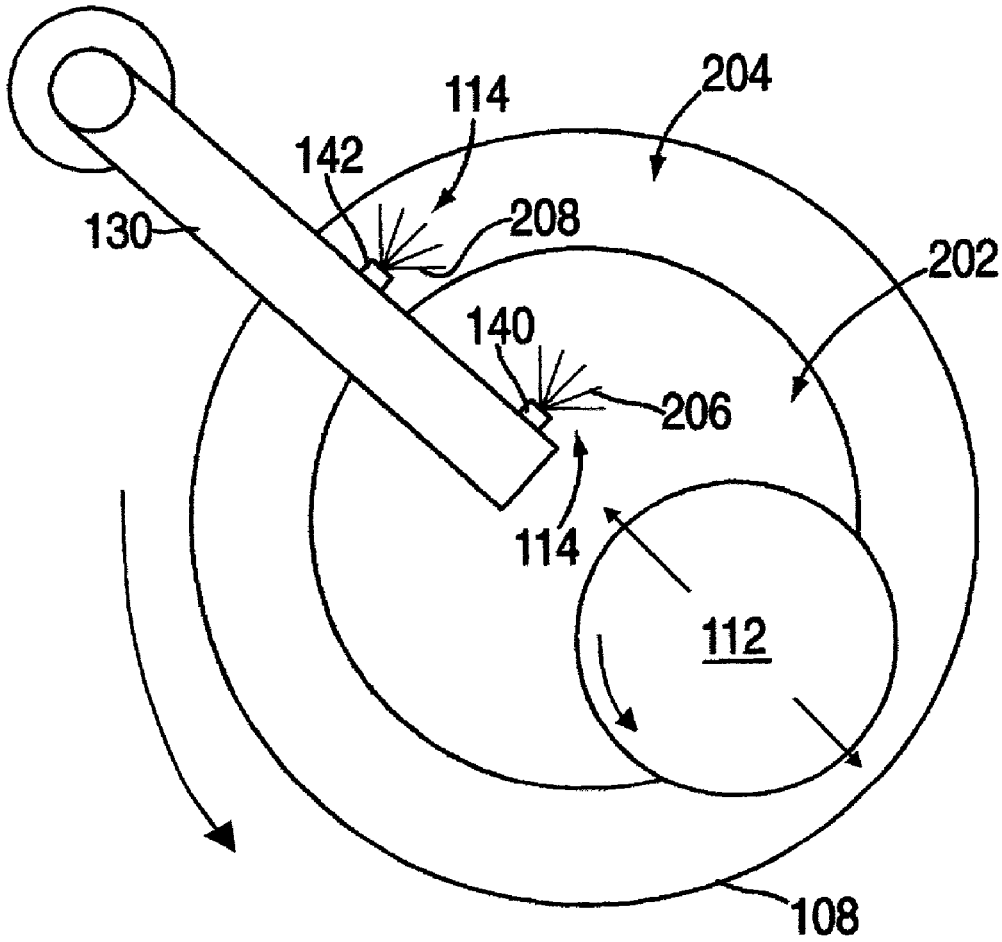
FIG. 2 is a plan view of the system of FIG. 1.

Referring to FIG. 2, the first nozzle 140 generally flows polishing fluid 114 at a first rate to a first portion 202 of the polishing surface 116 while the second nozzle 142 has no polishing fluid 114 exiting therefrom while positioned over a second portion 104 of the polishing surface 116. Depending on polishing fluid chemistries, among other factors, the flow of polishing fluid to one portion of the polishing surface 116 results in a faster (or slower) polishing rate in the substrate contacting that portion of the polishing surface 116. Upon a signal from a controller, the flow from the first nozzle 140 is stopped while a flow of polishing fluid 114 from the second nozzle 142 is started, thereby wetting the second portion 104 of the polishing surface 114. Correspondingly, the rate of polishing now shifts between the portion 102, 104 of the polishing surface 116. In this manner, the distribution of polishing fluid 114 across the width of the polishing material 108 is regulated to control a local rate of polishing across the width of the substrate.

Alternatively, one of the nozzles 140, 142 may have no flow during a first portion of a polishing cycle, while both nozzles 140, 142 may flow polishing fluid during another portion of the polishing cycle. Other combinations of fluid delivery are also contemplated.

Returning to FIG. 1, the flow rates exiting the first and second nozzles 140, 142 may be fixed relative to each other or controllable. In one embodiment, the fluid delivery arm 130 includes a polishing fluid supply line 124 that is teed between the first and second nozzles 140, 142. A tee fitting 126 is coupled to the supply line 124 and has a first delivery line 144 and a second delivery line 146 branching therefrom that are coupled respectively to the nozzles 140, 142.

At least one of the nozzles 132 contains a flow control mechanism 150. The flow control mechanism 150 is adapted to divert the flow between the nozzles 140, 142, and may additionally provide dynamic control of flow rates to the nozzles 140, 142. Examples of flow control mechanisms 150 include pinch valves, proportional valves, restrictors, needle valves, shut-off valves, metering pumps, mass flow controllers, diverter valves, and the like.

The polishing fluid source 134 is typically disposed externally to the system 100. In one embodiment, the polishing fluid source 134 generally includes a reservoir 152 and a pump 154. The pump 154 generally pumps the polishing fluid 114 from the reservoir 152 through the supply line 124 to the nozzles 132.

The polishing fluid 114 contained in the reservoir 152 is typically deionized water having chemical additives that provide chemical activity that assists in the removal of material from the surface of the substrate 112 being polished. As the polishing fluid 114 is supplied to the nozzles 132 from a single source (i.e., the reservoir 152), the fluid 114 flowing from the nozzles 132 is substantially homogeneous, i.e., not varied in concentration of chemical reagents or entrained matter. Optionally, the polishing fluid 114 may include abrasives to assist in the mechanical removal of material from the surface of the substrate and are commonly known as slurry in this form. The polishing fluids are generally available from a number of commercial sources such as Cabot Corporation of Aurora, Ill., Hitachi Chemical Company, of Japan, Dupont Corporation of Wilmington, Del. among others.

In operation, the substrate 112 is positioned in polishing head 106 and brought in contact with the polishing material 108 supported by the rotating platen 104. The polishing head 106 may hold the substrate stationary, or may rotate or otherwise move the substrate to augment the relative motion between the polishing material 108 and substrate 112. The polishing fluid delivery system 102 flows the polishing fluid 114 through the supply line 124 to the first polishing nozzle 140. After a predetermined amount of material is removed from the substrate, the flow of polishing fluid 114 is stopped from the first nozzle 140 and started from the second nozzle 142. The change in location (i.e., distribution) of polishing fluid 114 on the polishing surface 116 results in a change in the local polishing rate across the width of the substrate.

FIG. 2 depicts a plan view of the system 100 illustrating the flow of polishing fluid 114 onto center and outer portions 202, 204 of the polishing material 108. During a first portion of a polishing cycle, a first flow 206 of polishing fluid 114 flows out the first nozzle 140 and onto the outer or first portion 202 while no polishing fluid 114 exits the second nozzle 142. After a predetermined time, the flow through the first nozzle 140 is stopped and a second flow is begun to flow polishing fluid 114 through the second nozzle 142 over a second portion of the polishing cycle. Generally, the location on which the first flow 206 impinges the polishing surface 116 is different than the location of the second flow 208, thus providing a controlled distribution of polishing fluid 114 across the polishing surface 116 of the polishing material 108. In one embodiment, the first flow 206 has a rate about equal to a rate of the second flow 208. Alternatively, the rates may be different. The controlled distribution of the polishing fluid 114 across the polishing material 108 allows material removal from the surface of the substrate 112 to be tailored across the width of the substrate 112 by controlling the relative application of points polishing fluid 114 on the polishing material 108. For example, polishing fluid 114 may be first provided to the first portion 202 of the polishing material 108 then switch to the second portion 204 (or vice versa) to alter the polishing profile across the width of the substrate. Optionally, additional nozzles may be utilized to provide polishing fluid at different locations of the polishing material 108 where at least two portions of the polishing material 108 have polishing fluid 114 disposed thereon at different times during the process.

In one mode of operation for example, the substrate 112 being polished by the system 100 is processed with polishing fluid 114 provided from the first nozzle 140 for a predetermined period to polish the substrate faster near its center. The flow of polishing fluid 114 is then switched from the first nozzle 140 to the second nozzle 142. Polishing then continues for a predetermined period to polish the substrate faster near its edge. The resulting local polishing rates across the substrate may be tailored by switching the flow of polishing fluid between the nozzles 120, 140 as necessary to achieve a desired profile on the polished surface of the substrate.

Optionally, a polishing fluid delivery system having dynamic control over the flows from the nozzles 140, 142 may include a metrology device 118 to provide process feed-back for real-time adjustment of the polishing fluid distribution to facilitate in-situ adjustment of the polishing profile (i.e., changing the polishing profile over different portions of a polishing cycle of a single substrate). Typically, the metrology device 118 detects a polishing metric such as time of polish, thickness of the surface film being polished on the substrate, surface topography or other substrate attribute.

In one embodiment, the polishing material 108 may include a window 160 that allows the metrology device 118 to view the surface of the substrate 112 disposed against the polishing material 108. The metrology device 118 generally includes a sensor 162 that emits a beam 164 that passes through the window 160 to the substrate 112. A first portion of the beam 164 is reflected by the surface of the substrate 108 while a second portion of the beam 164 is reflected by a layer of material underlying the polished surface of the substrate 108. The reflected beams are received by the sensor 162 and a difference in wavelength between the two portions of reflected beams are resolved to determine the thickness of the material on the surface of the substrate 112. Generally, the thickness information is provided to a controller (not show) that adjusts the polishing fluid distribution on the polishing material 108 to produce a desired polishing result on the substrate's surface. One monitoring system that may be used to advantage is described in U.S. patent application Ser. No. 08/689,930, filed Aug. 16, 1996 by Birang et al., and is hereby incorporated herein by reference in its entirety.

Optionally, the metrology device 118 may include additional sensors to monitor polishing parameters across the width of the substrate 112. The additional sensors allow for the distribution of polishing fluid 114 to be adjusted across the width of the substrate 112 so that more or less material is removed in one portion relative another portion of the substrate 112. Additionally, the process of adjusting the flows from the nozzles 140, 142 may occur iteratively over the course of a polishing sequence to dynamically control the rate of material removal across the substrate 112 at any time. For example, the center of the substrate 112 may be polished faster by providing polishing fluid to the center of the substrate 112 at the beginning of a polishing sequence while the perimeter of the substrate 112 may be polished faster at the end of the polishing sequence by switching the flow of polishing fluid to the perimeter area.

Figure 3:
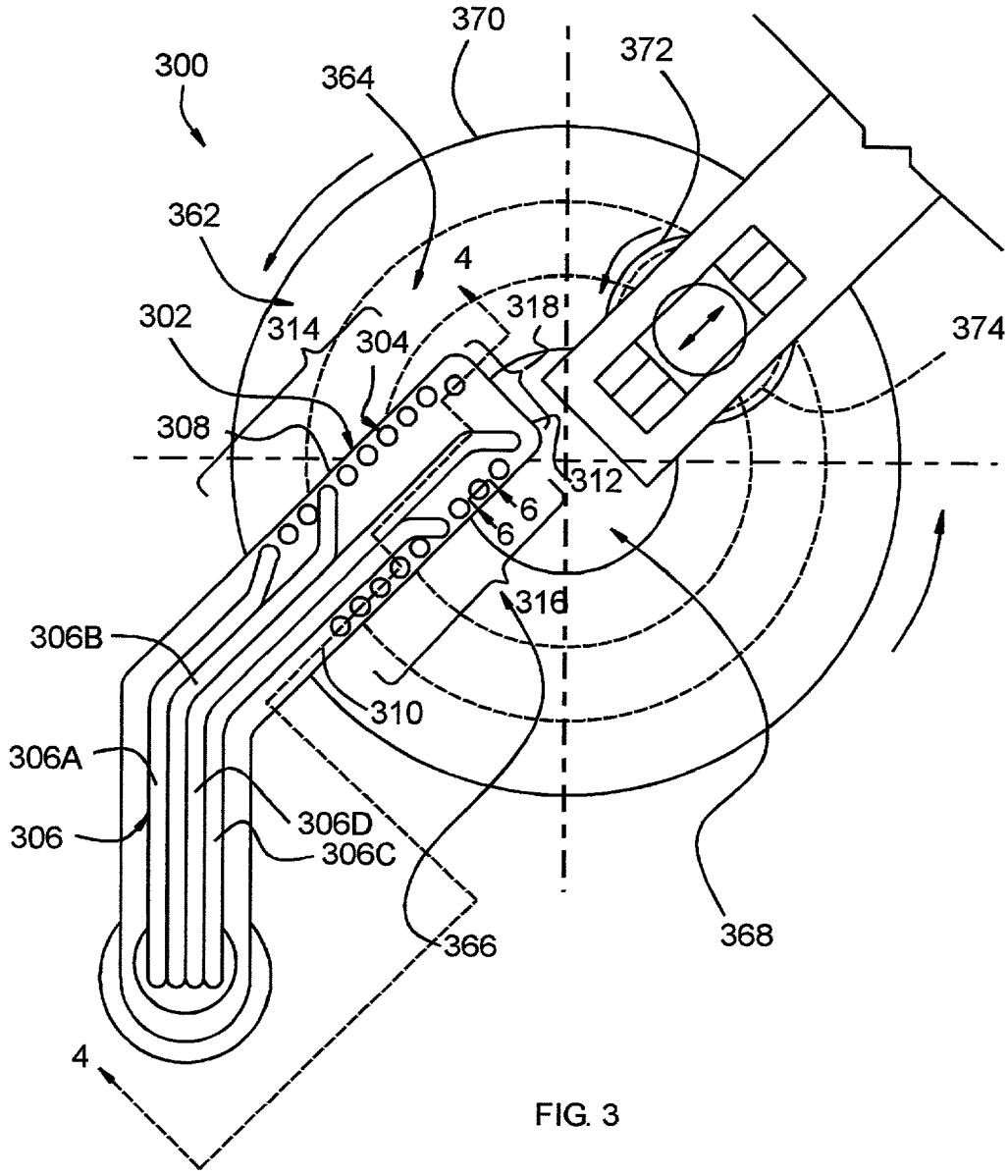
FIG. 3 is a top view of another embodiment of a polishing fluid delivery apparatus.

FIG. 3 depicts another embodiment of a polishing fluid delivery system 300. The system 300 includes an arm 302 that is adapted to position a plurality of polishing fluid delivery tubes 306 over a polishing surface 370. The arm 302 has a plurality of polishing fluid delivery tube receives, for example, holes 304 in which the tubes 306 are selectively positioned. Generally, the arm 302 has a greater number of holes 304 than tubes 306 thereby allowing the individual tubes 306 to be selectively positioned along the arm 302. As the position of the tubes 306 along the arm 302 dictate which portions of the polishing surface 370 receive polishing fluid during polishing, the choice of which holes 304 are used to position the tubes 306 controls the distribution of polishing fluid on the polishing surface 370, allowing the control of local polishing rates across the width of the substrate 374 (shown in phantom). It is contemplated that the position of the tubes 306 may be secured and adjusted along the arm 302 by other devices or methods, for example, clamps, sliders, straps and slots, among others.

The arm 302 includes a first lateral side 308 and an opposing second lateral side 310 typically orientated perpendicular to the polishing surface 370. A distal end 312 couples the sides 308, 310. The polishing fluid delivery tube receiving holes 304 are disposed at least along one of the sides 308, 310. The arm 302 may include a bend along its length to provide clearance for a polishing head 372 that retains a substrate 374 (shown in phantom) against the polishing surface 370 during processing.

In the embodiment depicted in FIG. 3, the holes 304 are arranged in along the sides 308, 310 and end 312 of the arm 300. A first set 314 of holes 304 is disposed along the first side 308, a second set 316 of holes 304 are disposed along the second side 310, and a third set 318 of holes 304 are disposed along the end 312. The number and position of holes 308 may vary to allow positioning of the tubes 306 at predetermined intervals to provide a predetermined polishing uniformity while polishing. For example, the first set 314 may include nine (9) holes 304 spaced at half inch intervals, the second set 316 may include ten (10) holes 304 space at half inch intervals while the third set 318 may include two (2) holes 304. Thus, the positions of the tubes 306 along the arm 302 may be selected to flow polishing fluid to discreet portions of the polishing surface thereby controlling the local polishing rates across the width of the substrate.

In the embodiment depicted in FIG. 3, the tubes 306 may be positioned in a predetermine group of holes 304 to produce a desired polishing uniformity on a substrate 374. A first tube 306A is positioned in one of the first set 314 of holes 304 to flow polishing fluid to a first portion 362 of the polishing surface 370. A second tube 306B is positioned in another of the first set 314 of holes 304 to flow polishing fluid to a second portion 364 of the polishing surface 370. A third tube 306C is positioned in one of the second set 316 of holes 304 to flow polishing fluid to a third portion 366 of the polishing surface 370. A fourth tube 306D is positioned in one of the third set 318 of holes 304 to flow polishing fluid to a first portion 362 of the polishing surface 370. By moving any one of the tubes 306A–D to another hole 304, the distribution of polishing fluid on the polishing surface 370 will be altered and correspondingly change the rate of material removal across the diameter of the substrate 374. The position of the tubes 306A–D may be moved along the arm 302 to produce a desired polishing result while polishing a single substrate (i.e., in-situ), to enhance system flexibility when polishing different materials, and to provide greater flexibility of process control for tuning a particular process to yield a defined polishing uniformity or polished profile of the substrate. For example, the tubes 306A–D may be re-positioned from a first group of holes 304 to a second group of holes 304 in response to a change in substrate surface characteristics, for example, a change from oxide to copper polishing, a change in surface profiles between incoming substrates or a change in feature width, among others.

Alternatively, the distribution of polishing fluid on the polishing surface 370 may be changed by sequentially flowing polishing fluid the tubes 306. For example, polishing fluid may be provided through tubes 306A–C during a first portion of a polishing process to polish the substrate 374 at a predetermined polishing rate profile across the diameter of the substrate (i.e., the rate of polishing is different across the diameter of the substrate). At a second portion of a polishing process, the flow through the fourth tube 306D is provided to change the distribution of polishing fluid on the polishing surface 370 to change the polishing rate profile. The flow through the tubes 306A–D may be turned on and off in various combinations to produce a corresponding polishing performance. The sequence of flow through the tubes 306A–D may be controlled in response to a sensed polishing metric as described above. Alternatively, the sequence of flow through the tubes 306A–D may be selected to yield uniform polishing of the substrate by compensating for changes in other process attributes or parameters that effect local polishing rates.

Figure 4:
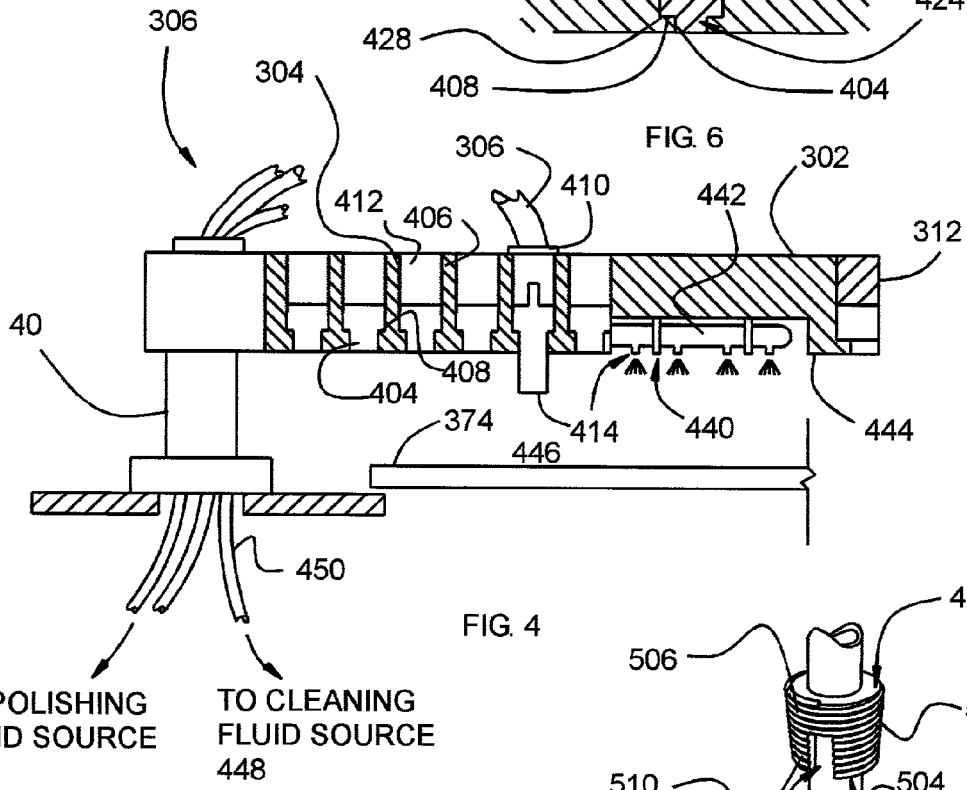
FIG. 4 is a sectional view of the polishing fluid delivery apparatus of FIG. 3 taken along section line 4—4.

Referring to FIG. 4, the arm 302 is generally supported by a post 402 that facilitates rotating the arm 302 over a polishing surface 370. The arm 302 is orientated perpendicular to the post 402 and, in one embodiment, is offset or bent along its length. The post 402 additionally provides a conduit for routing the tubes 306 to the arm 302.

Each hole 304 formed in the arm 302 typically includes an upper threaded portion 406 and lower portion 404. The lower portion 404 has a smaller diameter then a diameter of the upper portion 406, forming a step 408 within the hole 306. The lower portion 404 generally is configured to allow the tube 306 to pass snugly therethrough. The upper portion 406 includes a threaded section 412. Each tube 306 is retained in one of the holes 304 by a collet 410.

Figure 5:
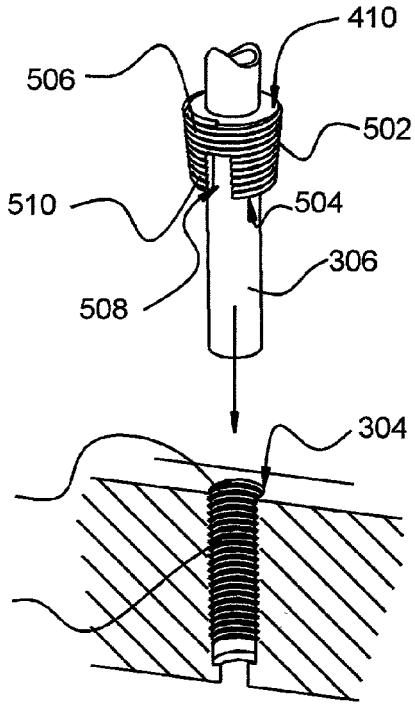
FIG. 5 is a partial top isometric view of one embodiment of a collet for retaining a polishing fluid delivery tube to the polishing fluid delivery apparatus.

Referring additionally to FIG. 5, the collet 410 has a generally tapered cylindrical form with a threaded exterior 502. The collet 410 tapers from a central ring 506 to a narrow end 504. The narrow end 504 of the collet 410 includes a plurality of slots 508 that define fingers 510 extending from the central ring 506. The ring 506 is configured to fit snugly over the tube 306. After the tube 306 is inserted into the hole 304 to the desired depth, the collet 410 is engaged with the threaded section 412 of the hole 304. The tapered shape of the collet 410 causes the fingers 510 to be urged inwards against the tube 306 as the collet 410 is threaded into the upper portion 406 of the hole 304, thereby clamping the tube 306 within the hole 304.

The collet 410 allows the tube 306 to extend below the arm 302 to a predetermined length. Thus, an outlet 414 of the tube 306 may be securely positioned proximate the polishing surface while the arm 302 is maintain at a greater distance from the polishing surface and away from contaminants and other debris the may deposit on the arm 302 and later contaminate and/or damage a substrate during polishing. In one embodiment, the outlet 414 of the tube 306 extends at least one inch below the arm 302.

Figure 6:
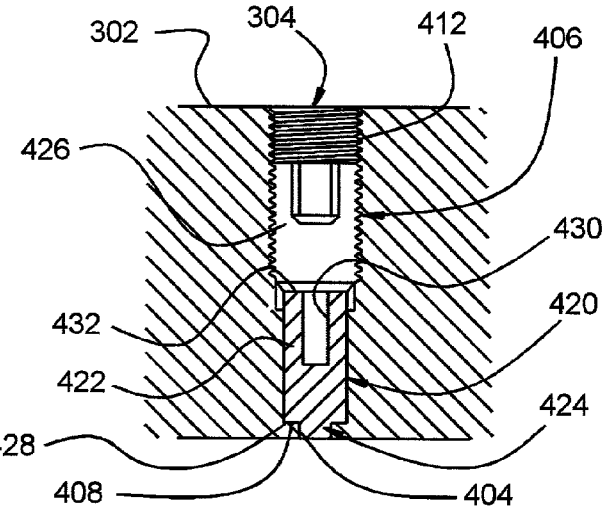
FIG. 6 is a partial sectional view of the polishing fluid delivery apparatus of FIG. 3 taken along section line 6—6.

FIGS. 4 and 6 depicts one embodiment of a plug 420 utilized to prevent polishing fluid and other contaminants from entering holes 304 that are not occupied by any of the tubes 306. The plug 420 generally includes a cylindrical body 422 having a concentric post 424 extending from a first end 428 and a threaded hole 430 formed concentrically in a second end 432. The post 424 is configured to snugly fill the lower portion 404 of the hole 304 to prevent polishing fluid and other contaminants from entering holes 304. The post 424 typically extends flush with or protrudes slightly from an underside 444 of the arm 302 facing the polishing surface 370. A set screw 426 is threaded into the upper portion 406 of the hole 306 and urges the plug 420 against the step 408 to secure the plug 420 within the hole 304. The plug 420 may be removed from the hole 304 by removing the set screw 426 and inserting a threaded object (not shown) into the threaded hole 430 of the plug 420. The plug 420 may then be pulled out from the hole 304.

Referring back to FIG. 4, the arm 300 may include an optional spray system 440. The spray system 440 generally includes a tube 442 coupled to an underside 444 of the arm 300. The tube 442 includes a plurality of nozzles 446 coupled to or formed in the tube 442 at spaced-apart intervals. The tube 442 is coupled to a cleaning source 448 by a conduit 450 routed through the post 402. The cleaning fluid source 448 generally provides pressurized cleaning fluid, such as de-ionized water, to the polishing surface 370 through the nozzles 446 to dislodge contaminants or other debris from the polishing surface. One spray system that may be adapted to benefit from the invention is described in U.S. Pat. No. 6,139,406, issued Oct. 31, 2000 to Kennedy, which is hereby incorporated by reference in its entirety.

Figure 7:
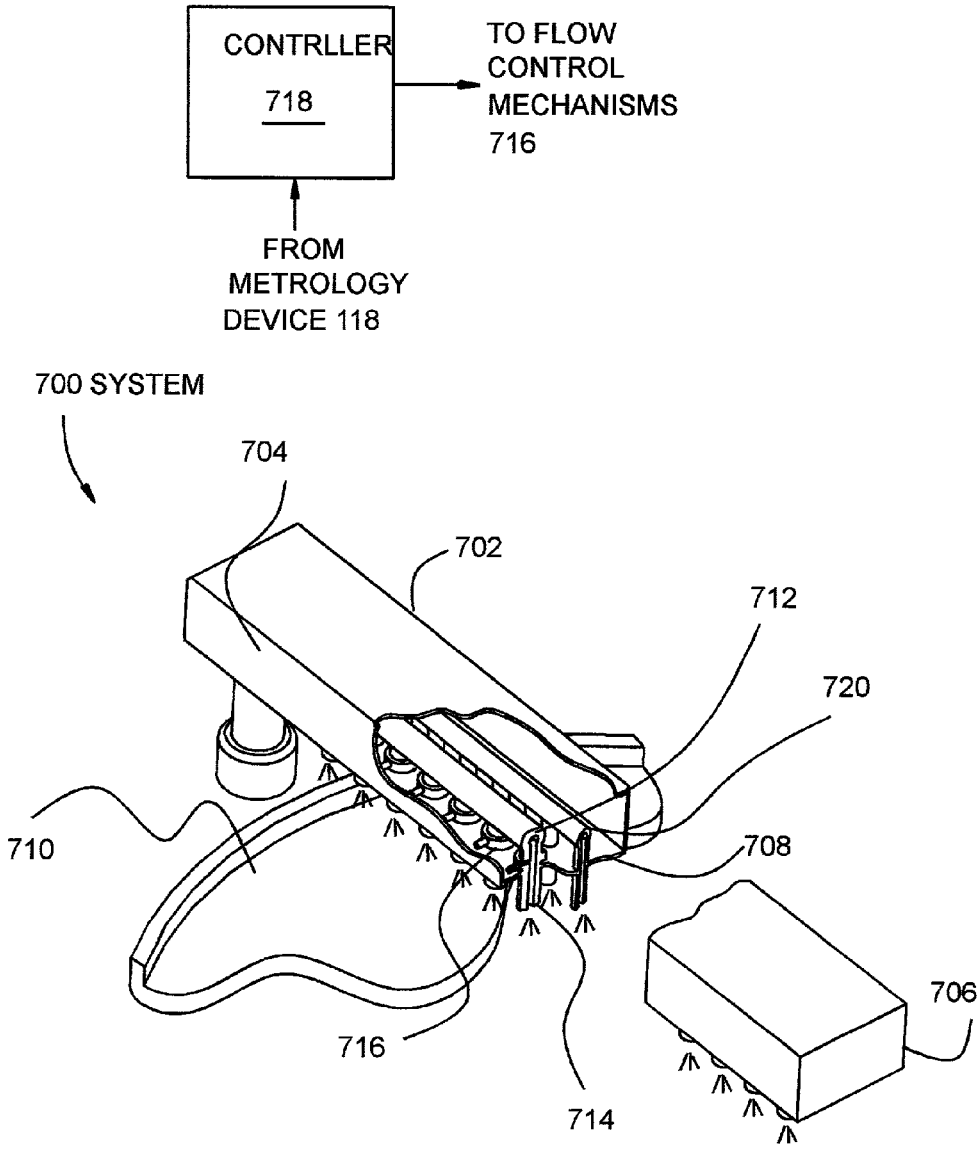
FIG. 7 is a cut-away isometric view of another embodiment of a polishing fluid delivery apparatus.

FIG. 7 depicts a sectional view of another embodiment of a polishing fluid delivery apparatus 700. The apparatus 700 includes an arm 702 having a first lateral side 704, an opposing second lateral side 706 and an under side 708 disposed between the sides 704, 706 that faces a polishing surface 710. The sides 704, 706 generally define a length of the arm 702, a portion of which is adapted to extend over the polishing surface 710.

A manifold 712, coupled to a polishing fluid source (not shown), extends along the length of the arm 702. The manifold 712 may be coupled to the arm 702, disposed in the arm 702 or formed integrally with the arm 702. The manifold 712 generally includes a plurality of outlets 714 disposed in a spaced-apart relation along the length of the manifold 712. The outlets 714 are adapted to flow polishing fluid from the manifold 712 to discreet portions of the polishing surface 710.

Each outlet 714 includes a flow control mechanism 716 coupled thereto. The flow control mechanism 716 may be a manual or automated flow control device, such as pinch valves, proportional valves, needle valves, shut-off valves, metering pumps and mass flow controllers among others. The flow control mechanisms 716 allow the flow from each outlet 714 to be selectively turned on or off to control the distribution of polishing fluid across the width of the polishing surface 710, which correspondingly results in control of a polishing profile of a substrate polished on the surface 710.

In one embodiment, the flow control mechanism 714, for example, a solenoid valve, is coupled to a controller 718. The controller 718 allows each flow control mechanism 714 to be opened or closed in a predetermined sequence to facilitate tailoring the rate of material removal across the diameter of a substrate being polished. The use of a controller 718 allows the rate profile to be adjusted in-situ. For example, the controller 718 may be coupled to a metrology device 118 as described in FIG. 1 to change the polishing profile in response to a polishing metric such as time of polish, thickness of the surface film being polished on the substrate, surface topography or other substrate attribute.

A spray system 720 may also be coupled to the arm 702 and adapted to spray cleaning fluid on the polishing surface 720. The spray system 720 is generally similar to the spray system 440 described with reference to FIG. 4.

Therefore, the polishing fluid delivery system allows for the rate of material removal during polishing to be tailored across the width of the substrate by controlling the distribution of polishing fluid to various portions of a polishing surface. The distribution of polishing fluid may be controlled by changing the positions of polishing fluid delivery tubes along an arm extending over the polishing surface, or by selectively turning on and off the flow from the tubes to polishing faster in one region of the substrate relative another. Although with creating a more flexible process window, controlling the distribution of the polishing fluid advantageously reduces the amount of polishing fluid consumed during polishing, thereby reducing processing costs.

Although the teachings of the present invention have been shown and described in detail herein, those skilled in the art can readily devise other varied embodiments that still incorporate the teachings and do not depart from the scope and spirit of the invention.

What is claimed is:

1. Apparatus for delivering a polishing fluid to a polishing surface of a chemical mechanical polisher, the apparatus comprising:

an arm having an underside adapted to face the polishing surface and a plurality of tube receivers;

a plurality of tubes adapted to flow polishing fluid coupled to the arm and positionable between at least two of the tube receivers, wherein said plurality of tube receivers are arranged along a length of the arm spanning a substantial radial region the polishing surface; and a means for selectively changing a polishing rate by selectively changing the combination of tubes through which polishing fluid flows.

2. The apparatus of claim 1, wherein at least two of the tube receivers define a first set of tube retaining holes and are arranged along a first side of the arm.

3. The apparatus of claim 2 further comprising:

a second set of tube retaining holes formed in the arm along a second side of the arm disposed opposite the first side.

4. The apparatus of claim 3, wherein the first set of tube retaining holes include holes spaced equally distant along the first side of the arm; and the second set of tube retaining holes include nine holes spaced equally distant along the second side of the arm.

5. The apparatus of claim 1 further comprising:

a collet disposed in each tube receiver, each tube coupled by the collet to the arm.

6. The apparatus of claim 1, wherein each tube receiver further comprises:

a first portion having a threaded section; and a second portion disposed coaxially to the first portion end having a diameter smaller than a diameter of the first portion.

7. The apparatus of claim 6 further comprising:

a tapered body disposed around at least one of the tubes and having a threaded exterior; and a plurality of fingers extending from a central ring of the tapered body, the fingers adapted to urge against the tube as the body is threaded into the upper portion of the hole.

8. The apparatus of claim 1 further comprising:

at least one plug disposed in a hole not occupied by the tubes.

9. The apparatus of claim 8, wherein the plug further comprises:

a central body; and a post extending from the central body, the post disposed at least flush with or protruding beyond the arm.

10. The apparatus of claim 9, wherein each hole further comprises:

a first portion having a threaded section;

a second portion disposed coaxially to the first portion and having a diameter smaller than a diameter of the first portion, the post of the plug filling the second portion;

a step defined at an interface between the first portion and the second portion; and a set screw engaged with the threaded section and urging the central body of the plug against the step.

11. The apparatus of claim 1, wherein at least one tube has an outlet adapted to dispense polishing fluid to the polishing surface that projects below the arm.

12. Apparatus for delivering a polishing fluid to a polishing surface of a chemical mechanical polisher, the apparatus comprising:

an arm;

a plurality of polishing fluid delivery tubes;

a plurality of holes formed in the arm, said plurality of holes distributed along a substantial length of the arm, for receiving the polishing fluid delivery tubes, each of the tubes disposed through one of the holes and coupled to the arm; and wherein a relationship between the polishing fluid delivery tubes and holes is expressed by:

$$A/B>1$$

where:

A is a number of holes; and

B Is a number of polishing fluid delivery tubes.

13. The apparatus of claim 12 further comprising:

a plug disposing in at least one of the holes.

14. The apparatus of claim 13, wherein each hole further comprises:

a first portion having a threaded section;

a second portion disposed coaxially to the first portion and having a diameter smaller than a diameter of the first portion, a post of the plug filling the second portion;

a step defined at an interface between the first portion and the second portion; and a set screw engaged with the threaded section and urging a central body of the plug against the step.

15. The apparatus of claim 12 further comprising:

a cleaning fluid delivery tube coupled to the arm;

a plurality of nozzles formed in the tube in a space-apart relation along the length of the arm.

16. The apparatus of claim 12, wherein the substantial length of the arm further comprises:

a region configured to radially span a portion of the polishing surface that is in contact with the substrate during processing.

17. A method for delivering a polishing fluid to a polishing surface of a chemical mechanical polisher, the method comprising:

providing a polishing fluid delivery arm having a plurality of tube retaining positions exceeding the number of polishing fluid delivery tubes coupled to the arm; and selecting a relative spacing between at least a first and a second polishing fluid delivery tube along the arm from the plurality of tube retaining positions to produce a desired polishing result.

18. The method of claim 17, wherein at least one of the polishing fluid tubes is moved to a different position along the arm in response to a change in surface characteristics of the substrate being polished.

19. The method of claim 17, wherein at least one of the polishing fluid tubes is moved to a different position along the arm to change local polishing rates across a diameter of a substrate.

20. The method of claim 17, wherein at least one of the polishing fluid tubes extends through the arm.

21. Apparatus for delivering a polishing fluid to a polishing surface of a chemical mechanical polisher, the apparatus comprising:

an arm having an underside adapted to face the polishing surface and a plurality of tube receivers;

a plurality of tubes adapted to flow polishing fluid coupled to the arm and positionable between at least two of the tube receivers that are spaced at different distances from a distal end of the arm, wherein at least two of the tube receivers define a first set of tube retaining holes and are arranged along a first side of the arm, wherein said plurality of tube receivers distributed along a length of the arm configured to span a polishing area of a polishing surface; and a second set of tube retaining holes formed in the arm along a second side of the arm disposed opposite the first side.

22. The apparatus of claim 21, wherein the first set of tube retaining holes include holes spaced equally distant along the first side of the arm; and the second set of tube retaining holes include nine holes spaced equally distant along the second side of the arm.

23. Apparatus for delivering a polishing fluid to a polishing surface of a chemical mechanical polisher, the apparatus comprising:

an arm having an underside adapted to face the polishing surface and a plurality of tube receivers; and a plurality of tubes adapted to flow polishing fluid coupled to the arm and positionable between at least two of the tube receivers that are spaced at different distances from a distal end of the arm, wherein said plurality of tube receivers are distributed along a substantial length of the arm, wherein each tube receiver further comprises:

a first portion having a threaded section; and a second portion disposed coaxially to the first portion and having a diameter smaller than a diameter of the first portion.

24. The apparatus of claim 23 further comprising:

a tapered body disposed around at least one of the tubes and having a threaded exterior, and a plurality of fingers extending from a central ring of the tapered body, the fingers adapted to urge against the tube as the body is threaded into the upper portion of the hole.

25. Apparatus for delivering a polishing fluid to a polishing surface of a chemical mechanical polisher, the apparatus comprising:

an arm having an underside adapted to face the polishing surface and a plurality of tube receivers;

a plurality of tubes adapted to flow polishing fluid coupled to the arm and positionable between at least two of the tube receivers that are spaced at different distances from a distal end of the arm, wherein said plurality of tube receivers are distributed along a length of the arm; and at least one plug disposed in a hole not occupied by the tubes.

26. The apparatus of claim 25, wherein the plug further comprises:

a central body; and a post extending from the central body, the post disposed at least flush with or protruding beyond the arm.

27. The apparatus of claim 26, wherein each hole further comprises:

a first portion having a threaded section;

a second portion disposed coaxially to the first portion and having a diameter smaller than a diameter of the first portion, the post of the plug filling the second portion;

a step defined at an interface between the first portion and the second portion; and a set screw engaged with the threaded section and urging the central body of the plug against the step.

* * * * *

UNITED STATES PATENT AND TRADEMARK OFFICE

CERTIFICATE OF CORRECTION

PATENT NO. : 7,086,933 B2
APPLICATION NO. : 10/131638
DATED : August 8, 2006
INVENTOR(S) : Vereen et al.

It is certified that error appears in the above-identified patent and that said Letters Patent is hereby corrected as shown below:

Column 1, Line 49: Change “a” to --as--

Column 3, Line 49: Change “fix” to --fixed--

Column 7, Line 35: Change “space” to --spaced--

Column 7, Line 42: Change “predetermine” to --predetermined--

Column 8, Line 6: After “fluid”, insert --through--

Column 8, Line 54: Change “maintain” to --maintained--

Column 8, Line 56: After “debris”, change “the” to --that--

Column 10, Claim 1, Line 32: After “region”, insert --of--

Column 11, Claim 12, Line 35: Change “Is” to --is--

Signed and Sealed this

Thirteenth Day of February, 2007

JON W. DUDAS
*Director of the United States Patent and Trademark Office*